US006727472B2

(12) United States Patent
Mondal et al.

(10) Patent No.: US 6,727,472 B2
(45) Date of Patent: Apr. 27, 2004

(54) SHEATHED-ELEMENT GLOW PLUG

(75) Inventors: Pia Mondal, Stuttgart (DE); Christine Engel, Leonberg (DE); Andreas Reissner, Stuttgart (DE); Wolfgang Dressler, Vaihingen/Enz (DE); Horst Boeder, Sindelfingen (DE); Christoph Kern, Aspach (DE); Steffen Schott, Schwieberdingen (DE); Ruth Hoffmann, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 14 days.

(21) Appl. No.: 10/069,212

(22) PCT Filed: May 26, 2001

(86) PCT No.: PCT/DE01/02032

§ 371 (c)(1),
(2), (4) Date: Jul. 10, 2002

(87) PCT Pub. No.: WO02/01112

PCT Pub. Date: Jan. 3, 2002

(65) Prior Publication Data

US 2003/0116553 A1 Jun. 26, 2003

(30) Foreign Application Priority Data

Jun. 24, 2000 (DE) ..... 100 30 924

(51) Int. Cl.[7] ..... F23Q 7/22
(52) U.S. Cl. ..... 219/270; 123/145 A
(58) Field of Search ..... 219/270, 253, 219/267; 123/145 A

(56) References Cited

U.S. PATENT DOCUMENTS

| | | | | | |
|---|---|---|---|---|---|
| 4,475,029 | A | | 10/1984 | Yoshida et al. | |
| 4,486,651 | A | * | 12/1984 | Atsumi et al. | 219/553 |
| 4,874,923 | A | * | 10/1989 | Hatanaka et al. | 219/270 |
| 4,914,751 | A | * | 4/1990 | Masaka et al. | 219/270 |
| 5,206,484 | A | * | 4/1993 | Issartel | 219/270 |
| 5,304,778 | A | * | 4/1994 | Dasgupta et al. | 219/270 |
| 5,750,958 | A | * | 5/1998 | Okuda et al. | 219/267 |
| 5,998,765 | A | * | 12/1999 | Mizuno et al. | 219/270 |
| 6,013,898 | A | * | 1/2000 | Mizuno et al. | 219/270 |
| 6,054,680 | A | * | 4/2000 | Locher et al. | 219/270 |
| 6,335,516 | B1 | * | 1/2002 | Muller et al. | 219/270 |

FOREIGN PATENT DOCUMENTS

| | | | | |
|---|---|---|---|---|
| DE | 003924777 | * | 2/1990 | F23Q/7/00 |
| DE | 39 24 777 | | 2/1990 | |
| DE | WO01/42714 | * | 6/2001 | F23Q/7/00 |
| FR | 2 641 156 | | 6/1990 | |

* cited by examiner

*Primary Examiner*—Ehud Gartenberg
*Assistant Examiner*—Leonid Fastovsky
(74) *Attorney, Agent, or Firm*—Kenyon & Kenyon

(57) ABSTRACT

A sheathed-element glow plug to be mounted in a combustion chamber is proposed, a rod-shaped heating element being situated in a concentric bore hole of the housing. The heating element has a first current-carrying layer, a second current-carrying layer, and an insulating layer, the insulating layer separating the first current-carrying layer and the second current-carrying layer. The first current-carrying layer and the second current-carrying layer being connected at the end of the heating element on the combustion chamber side by a conducting-layer crosspiece. The first current-carrying layer and the second current-carrying layer are different lengths, the cross section of the first current-carrying layer in a first section at the end of the heating element away from the combustion chamber being greater than the cross section of its remaining length, and the second current-carrying layer not extending into the first section.

9 Claims, 3 Drawing Sheets

SHEATHED-ELEMENT GLOW PLUG

FIELD OF THE INVENTION

The present invention relates to a sheathed-element glow plug to be mounted in a combustion chamber.

BACKGROUND INFORMATION

Sheathed-element glow plugs, having a metallic housing, to be mounted in a combustion chamber are already known. A rod-shaped heating element is situated in a concentric bore hole of the known sheathed-element glow plug, the heating element having a first current-carrying layer and a second current-carrying layer, the cross sections of the first and the second current-carrying layer being connected on the end of the heating element on the combustion chamber side via a conducting-layer crosspiece. In this context, the first and the second current-carrying layers are separated by an insulating layer. Furthermore, sheathed-element glow plugs are known whose current-carrying layers vary in length.

SUMMARY OF THE INVENTION

In contrast, the sheathed-element glow plug of the present invention has the advantage that there is no danger of a short circuit at the end of the heating element away from the combustion chamber. A further advantage is that the contact surface between the first current-carrying layer and the contact element situated at the end of the heating element away from the combustion chamber is enlarged. The contact resistance is consequently reduced, thereby resulting in the contact point heating up less. Therefore, the danger of the contact material between the heating element and the contact element being thermally destroyed is decreased. In addition, it is advantageous that the rod-shaped heating element does not need to be adjusted to remove an insulating layer situated on the rod-shaped heating element in the region in which the current supply is to be contacted.

It is particularly advantageous to also design the insulating layer to be asymmetrical, so that the danger of a short circuit due to damage or a porousness of an insulating layer deposited on the heating element is also decreased in this instance. In this context, it is advantageous to expand the region in which the insulating layer is asymmetrically formed in the direction of the combustion chamber over the collar of the heating element, since a summation of form-dependent and material-dependent stress concentration is prevented in this manner. In addition, it is advantageous to design the heating element such that an advantageously half-shell-shaped insulating layer made of an electrically insulating, ceramic material is deposited in the region in which the first current-carrying layer extends into the housing, the insulating layer between first and second current-carrying layer being made of the same material. As a result, the manufacturing process is simplified and, thus, more cost-effective. In order to be able to dispense with additional insulation, it is advantageous to design the insulating layer such that it extends beyond the end of the housing on the combustion chamber side. Furthermore, it is advantageous to provide a stepped lug at the end of the heating element away from the combustion chamber, so that an adapter sleeve situated on the end of the heating element away from the combustion chamber and the contact element are able to be easily positioned.

DETAILED DESCRIPTION

Figure 1:
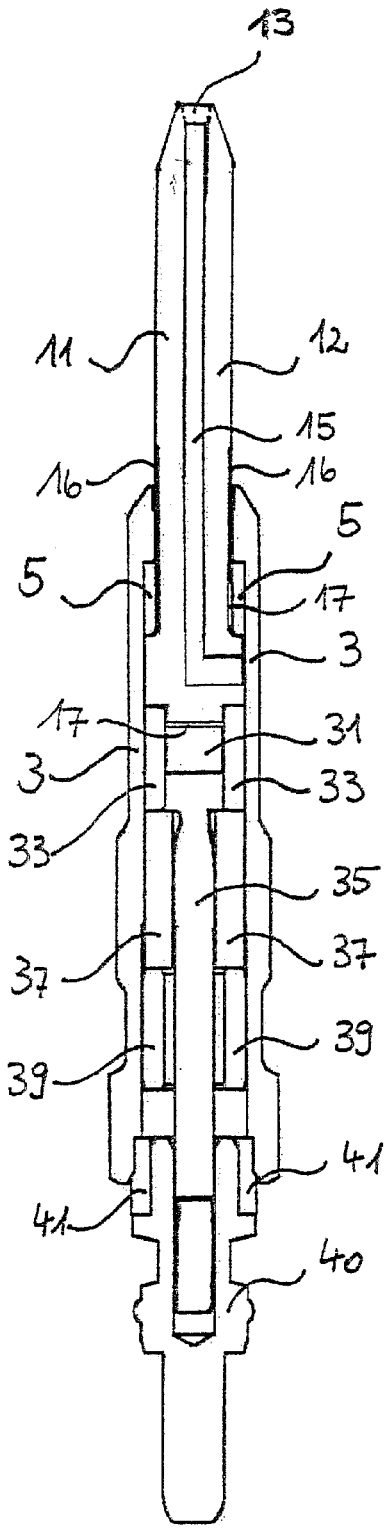
FIG. 1 schematically shows a longitudinal section of a sheathed-element glow plug according to the present invention.

The longitudinal section of a sheathed-element glow plug of present invention is schematically shown in FIG. 1. The sheathed-element glow plug has a housing 3, which is preferably made of a metallic material, a heating element being situated in the housing's concentric, continuous bore hole, on the end on the combustion chamber side. The heating element includes a first current-carrying layer 11, a second current-carrying layer 12, and an intermediary insulating layer 15. First current-carrying layer 11 and second current-carrying layer 12 are connected by a conducting-layer crosspiece 13 at the end of the heating element on the combustion chamber side. The described configuration of first current-carrying layer 11, second current-carrying layer 12, and conducting-layer crosspiece 13 results in a U-shaped configuration of the current-carrying layers. First current-carrying layer 11 is electrically contacted on the end of the heating element away from the combustion chamber to a contact element 31, which is preferably designed as a graphite pellet or another flexible and conductive element (e.g. a metal spring). Contact element 31 and the end of terminal stud 35 on the combustion chamber side, the terminal stud being situated on the end of contact element 31 away from the combustion chamber, are situated in a first adapter sleeve 33, first adapter sleeve 33 being the shape of a hollow cylinder and being made of an electrically insulating material. Terminal stud 35 extends to the end of the sheathed-element glow plug away from the combustion chamber and runs in the inner, concentric bore hole of housing 3. In this context, additional elements (second adapter sleeve 37 and metal ring 39), which are the shape of a hollow cylinder and through which terminal stud 35 runs, are situated in this bore hole. A contact plug 40 representing the connection to the glow plug switching circuit is placed on terminal stud 35 on the end away from the combustion chamber. A sealing ring 41, which seals the inside of the housing of the sheathed-element glow plug from the external space, is situated between housing 3 and contact plug 40. This sealing ring 41 is also in the shape of a hollow cylinder.

The second current-carrying layer is electrically contacted via a region in which electrically insulating layer 16, which surrounds the end of the heating element away from the combustion chamber, is removed, and also via sealant 5 to housing 3. Sealant 5 is situated around the end of the heating element away from the combustion chamber in the shape of a ring and seals the inside of the housing in the direction of the combustion chamber. In a preferred exemplary embodiment, a contact layer 17 may also be deposited in the region in which the second current-carrying layer is to be contacted by sealant 5. Furthermore, a contact layer 17 on the end of the heating element away from the combustion chamber may also produce the contact between first current-carrying layer 11 and contact element 31.

Figure 2:
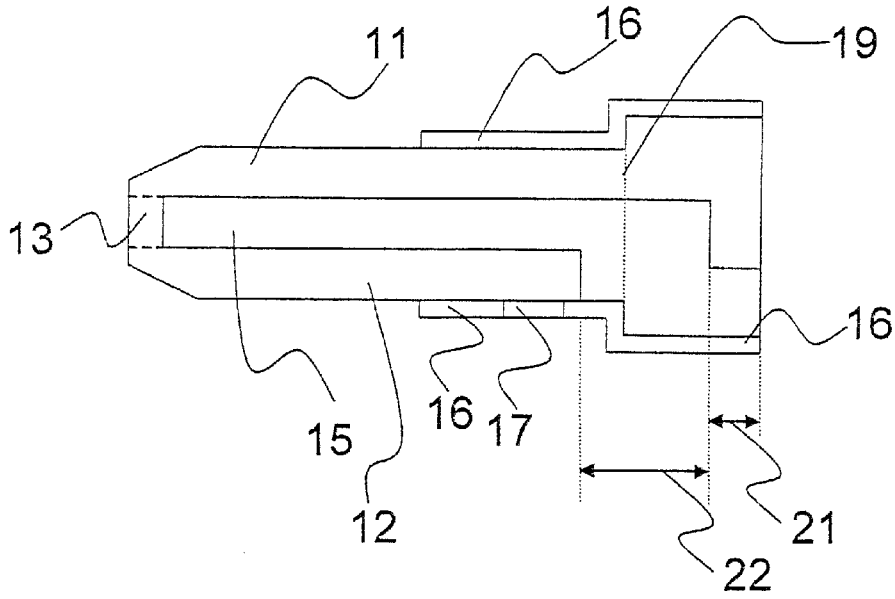
FIG. 2 schematically shows a longitudinal section of one exemplary embodiment for a heating element of a sheathed-element glow plug according to the present invention.

The construction of the heating element is to be described in more detail on the basis of FIG. 2. FIG. 2 schematically shows the longitudinal section of a heating element of a sheathed-element glow plug according to the present invention. Identical reference numerals used in this and in the following figures in reference to FIG. 1 designate identical elements. Therefore, this will not be discussed again in detail. FIG. 2 shows that, on the end of the heating element away from the combustion chamber, in a first section 21, first current-carrying layer 11 has a cross section that is enlarged with respect to the cross section of the remaining length of first current-carrying layer 11. As such, the longitudinal section of first current-carrying layer 11 has an asymmetrical L-shaped design. The regions of first section 21 on the end of the heating element away from the combustion chamber that are not filled by first current-carrying layer 11 are filled by insulating layer 15. Second current-carrying layer 12 does not protrude into this first segment 21 of the heating element.

In a preferred exemplary embodiment, first current-carrying layer 11 is so significantly enlarged in first section 21 that the cross section of first current-carrying layer 11 in this section corresponds to the cross section of the heating element. The design of this exemplary embodiment may also be seen in FIG. 1.

Widening the cross section of first current-carrying layer 11 ensures an enlarged contact area between first current-carrying layer 11 and contact element 31, which is situated at the end of the heating element away from the combustion chamber. This increase in the contact area results in a decrease in the contact-resistance and, thus, in a less significant heating of this region.

In the direction of the combustion chamber, a second section 22, in which the cross section of insulating layer 15 is asymmetrically enlarged with respect to the cross section of its remaining length, i.e., the cross section in the direction of the combustion chamber, borders first section 21 of the heating element. Second current-carrying layer 12 also does not extend into this second section 22. In this context, the end of second section 22 on the side of the combustion chamber may be selected such that it is a component of the heating-element collar (see FIG. 1) or of the heating-element shaft (see FIG. 2) or is situated exactly at junction 19 between the heating-element collar and the heating-element shaft. In this context, the region of the heating element having the greatest cross section at the end away from the combustion chamber is referred to as the heating-element collar. The region of the heating element bordering the heating-element shaft in the direction of the combustion chamber and not belonging to the heating-element collar is referred to as the heating-element shaft. Preferably, the end of second section 22 is not situated such that it is precisely at junction 19 between the heating-element shaft and heating-element collar, since an additional stress concentration due to the material junction at the particularly stressed point of the junction between the heating-element shaft and the heating-element collar is prevented in this manner. The proposed formation of insulating layer 15 effectively prevents a short circuit between first current-carrying layer 11 and second current-carrying layer 12 at the end of the heating element away from the combustion chamber.

As shown in FIG. 2, an insulating layer 16, which is preferably designed as a glass coating, is situated at the end of the heating element away from the combustion chamber, in the region of the shell. In region 17, in which second current-carrying layer 12 is in electrical contact with sealant 5, this insulating layer 16 is either interrupted or a contact layer 17, which improves the contact between second current-carrying layer 12 and sealant 5, is formed. This contact layer 17 may preferably be designed as a metallic layer.

Figure 3:
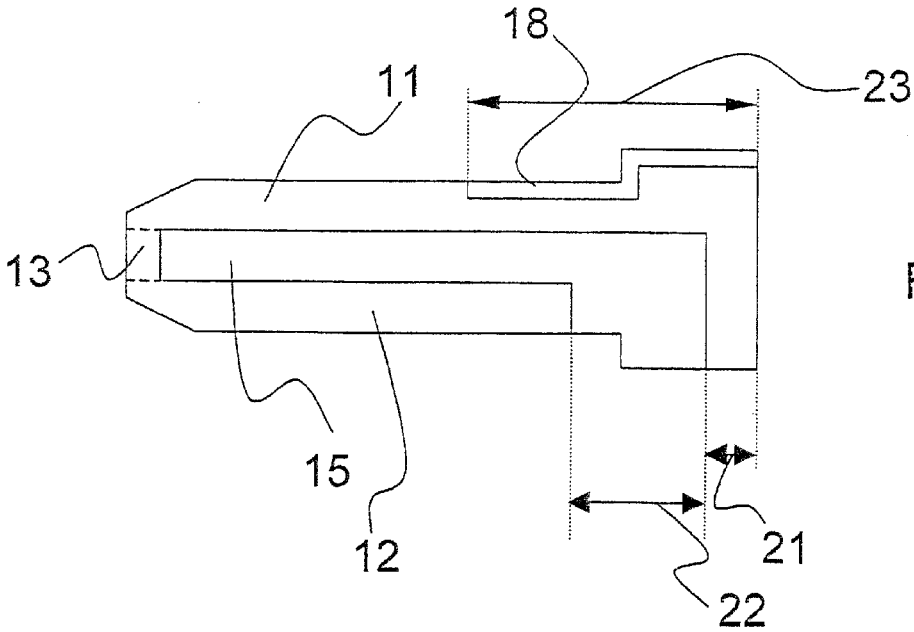
FIG. 3 schematically shows a longitudinal section of another exemplary embodiment for a heating element of a sheathed-element glow plug according to the present invention.

FIG. 3 schematically shows a longitudinal cross section of a further exemplary embodiment of a heating element of a sheathed-element glow plug of the present invention. This heating element does not have an insulating layer 16, which completely surrounds the end of the heating element on the combustion chamber side, but only an insulating layer 18 in the region in which the first current-carrying layer would be in contact with housing 3 without insulating layer 18. Insulating layer 18 is preferably shaped like a half-shell. Section 23, in which insulating layer 18 is deposited, is referred to as third section 23 in the following. In this context, it is advantageous when insulating layer 18 extends from the end of the heating element away from the combustion chamber over the edge of the housing. Thus, a short circuit between first current-carrying layer 11 and housing 3 is effectively prevented as a result of the thickness of insulating layer 18 being up to several 100$\mu$m.

In a particularly preferred exemplary embodiment, insulating layer 18 is made from the same material as insulating layer 15. Consequently, a manufacturing process including the manufacture of a laminate of electrically insulating and electrically conductive ceramic layers is possible in a particularly cost-effective manner, since all layers are able to produced using the same systems and devices. A process step involving depositing a chemically different layer is consequently eliminated.

Figure 4:
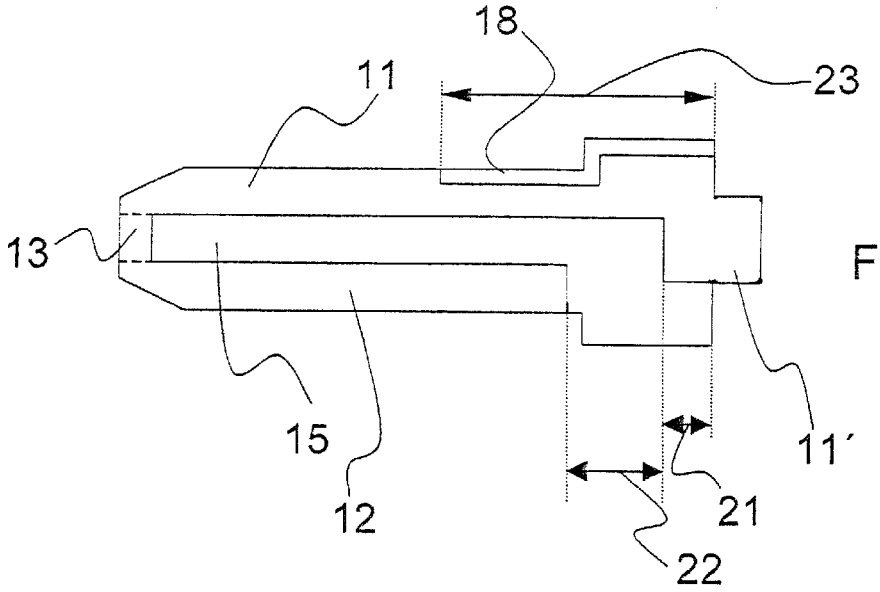
FIG. 4 schematically shows a longitudinal section of another exemplary embodiment for a heating element of a sheathed-element glow plug according to the present invention.

FIG. 4 schematically shows a further exemplary embodiment of a heating element of a sheathed-element glow plug according to the present invention. The heating element has on the end away from the combustion chamber a stepped lug 11', which connects to first current-carrying layer 11 and is made of the same material as first current-carrying layer 11. This stepped lug is used to precisely place contacting element 31 and first adapter sleeve 33, as also shown in FIG. 1.

Figure 5:
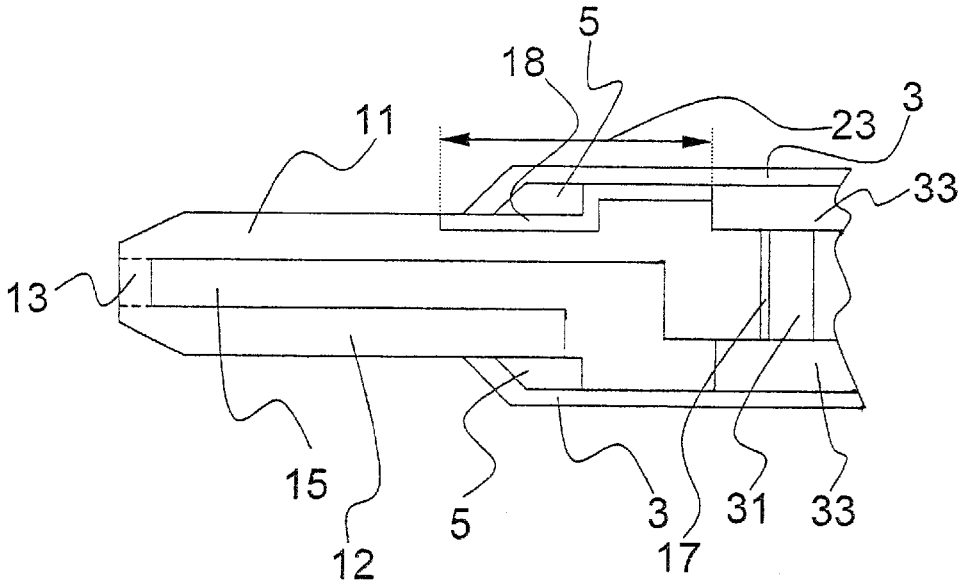
FIG. 5 schematically shows a longitudinal section of the end of a sheathed-element glow plug of the present invention on the combustion chamber side.

FIG. 5 schematically shows a longitudinal cross section of a further exemplary embodiment of a sheathed-element glow plug according to the present invention. In this context, the Figure is limited to the end of the sheathed-element glow plug on the combustion chamber side. This drawing is to be used to show again that insulating layer 18 or third section 23 extends from the end of the heating element away from the combustion chamber and adjacent to the housing beyond the edge of housing 3 on the side of the combustion chamber. As already described in light of FIG. 1, a first adapter sleeve 33 and a contact element 31 connect to the end of the heating element away from the combustion chamber. In a preferred exemplary embodiment, the end face of lug 11' of second insulating layer 11 facing away from the combustion chamber may be provided with a contact layer 17, which improves the contact between first insulating layer 11 and contact element 31.

In all of the exemplary embodiments, first current-carrying layer 11, second current-carrying layer 12, and conducting-layer crosspiece 13 are made of electrically conductive ceramic material. Insulating layer 15 is made of electrically insulating material. The ceramic, electrically conductive and electrically insulating materials are preferably ceramic composite structures including at least two of the compounds $Al_2O_3$, $MoSi_2$, $Si_3N_4$, and $Y_2O_3$. These composite structures are able to be obtained using a one-step or multi-step sintering process. The specific resistivity of the layers may preferably be determined by the $MoSi_2$ content and/or the particle size of the $MoSi_2$. The $MoSi_2$ content of first and second current-carrying layers 11, 12 and of conducting-layer crosspiece 13 is preferably greater than the $MoSi_2$ content of insulating layer 15.

In a further exemplary embodiment, first and second current-carrying layers 11, 12, conducting-layer crosspiece 13, and insulating layer 15 are made of a composite precursor ceramic having different proportions of fillers. In this context, the matrix of this material is made of polysiloxanes, polysilsequioxanes, polysilanes, or polysilazanes that may be doped with boron or aluminum and are produced by pyrolysis. At least one of the compounds $Al_2O_3$, $MoSi_2$, and SiC forms the filler for the individual layers. Analogously to the abovementioned composite structure, the $MoSi_2$ content and/or the particle size of the $MoSi_2$ may preferably determine the specific resistivity of the layers. Preferably, the $MoSi_2$ content of first and second current-carrying layers 11, 12 and of conducting-layer crosspiece 13 is greater than the $MoSi_2$ content of insulating layer 15.

The compositions of insulating layer 15, first and second current-carrying layers 11, 12, and conducting-layer crosspiece 13 are selected in the abovementioned exemplary embodiments such that their thermal expansion coefficients and the shrinkage of the individual lead layers, conducting-layer crosspiece layers, and insulating layers occurring during the sintering or pyrolysis process are equal, so that there are no cracks in the sheathed-element glow plug.

What is claimed is:

1. A sheathed-element glow plug to be mounted in a combustion chamber, comprising:

a housing;

a rod-shaped heating element situated in a concentric bore hole of the housing, the heating element including a first current-carrying layer and a second current-carrying layer, wherein:

the first current-carrying layer has a length that is different than a length of the second current-carrying layer;

a conducting-layer crosspiece, the first current-carrying layer and the second current-carrying layer being connected to an end of the heating element on a combustion chamber side via the conducting-layer crosspiece;

a first insulating layer for separating the first current-carrying layer from the second current-carrying layer, wherein:

a cross section of the first current-carrying layer in a first section at an end of the heating element away from the combustion chamber is greater than a cross section of a remaining length of the first current-carrying layer; and the second current-carrying layer does not extend into the first section;

an external second insulating layer surrounding the first current-carrying layer over a length of a third section of the heating element.

2. The sheathed-element glow plug according to claim 1, wherein:

the cross section of the first current-carrying layer in the first section corresponds to a cross section of the heating element.

3. The sheathed-element glow plug according to claim 1, wherein:

the third section of the heating element extends from the end of the heating element away from the combustion chamber beyond an end of the housing away from the combustion chamber.

4. The sheathed-element glow plug according to claim 1, wherein:

the first current-carrying layer, the second current-carrying layer, and the conducting-layer crosspiece are made of an electrically conducting ceramic material, and the first insulating layer and the external second insulating layer are made of an electrically insulating ceramic material.

5. The sheathed-element glow plug according to claim 4, wherein:

the first insulating layer and the external second insulating layer are made of the same electrically insulating ceramic material.

6. A sheathed-element glow plug to be mounted in a combustion chamber, comprising:

a housing;

a rod-shaped heating element situated in a concentric bore hole of the housing, the heating element including a first current-carrying layer and a second current-carrying layer, wherein:

the first current-carrying layer has a length that is different than a length of the second current-carrying layer;

a conducting-layer crosspiece, the first current-carrying layer and the second current-carrying layer being connected to an end of the heating element on a combustion chamber side via the conducting-layer crosspiece; and a first insulating layer for separating the first current-carrying layer from the second current-carrying layer, wherein:

a cross section of the first current-carrying layer in a first section at an end of the heating element away from the combustion chamber is greater than a cross section of a remaining length of the first current-carrying layer, the second current-carrying layer does not extend into the first section;

the cross section of the first current-carrying layer in the first section corresponds to a cross section of the heating element;

a cross section of the first insulating layer in a second section is greater than a cross section of a remaining length of the first insulating layer;

the second section borders the first section in a direction of the combustion chamber; and the second current-carrying layer does not extend into the second section.

7. The sheathed-element glow plug according to claim 6, wherein:

an end of the second section of the heating element on the combustion chamber side is not situated at a junction between a heating-element collar and a heating-element shaft.

8. A sheathed-element glow plug to be mounted in a combustion chamber, comprising:

a housing;

a rod-shaped heating element situated in a concentric bore hole of the housing, the heating element including a first current-carrying layer and a second current-carrying layer, wherein:

the first current-carrying layer has a length that is different than a length of the second current-carrying layer;

a conducting-layer crosspiece, the first current-carrying layer and the second current-carrying layer being connected to an end of the heating element on a combustion chamber side via the conducting-layer crosspiece; and a first insulating layer for separating the first current-carrying layer from the second current-carrying layer, wherein:

a cross section of the first current-carrying layer in a first section at an end of the heating element away from the combustion chamber is greater than a cross section of a remaining length of the first current-carrying layer;

the second current-carrying layer does not extend into the first section; and the first current-carrying layer includes a stepped lug at an end of the first section of the heating element away from the combustion chamber.

9. The sheathed-element glow plug according to claim 8, wherein:

the cross section of the first current-carrying layer in the first section corresponds to a cross section of the heating element.

* * * * *